US007032558B2

(12) United States Patent
Nieda et al.

(10) Patent No.: US 7,032,558 B2
(45) Date of Patent: Apr. 25, 2006

(54) RECOIL STARTER

(75) Inventors: Seiichi Nieda, Suginami-ku (JP); Hideki Hashiba, Suginami-ku (JP); Isao Tohyama, Suginami-ku (JP)

(73) Assignee: Starting Industrial Co., Ltd., Tokyo (JP)

( * ) Notice: Subject to any disclaimer, the term of this patent is extended or adjusted under 35 U.S.C. 154(b) by 0 days.

(21) Appl. No.: 10/920,164

(22) Filed: Aug. 18, 2004

(65) Prior Publication Data

US 2005/0056248 A1 Mar. 17, 2005

(30) Foreign Application Priority Data

Aug. 19, 2003 (JP) ..... P.2003-295534

(51) Int. Cl.
*F02N 3/02* (2006.01)

(52) U.S. Cl. ..... 123/185.3; 74/7 C; 192/42; 192/46

(58) Field of Classification Search ..... 123/185.2, 123/185.3, 185.4; 74/7 C; 192/42, 46
See application file for complete search history.

(56) References Cited

U.S. PATENT DOCUMENTS 3,730,162 A * 5/1973 Murase ..... 123/185.3

FOREIGN PATENT DOCUMENTS

JP 2-124268 U 10/1990

* cited by examiner

*Primary Examiner*—Andrew M. Dolinar
(74) *Attorney, Agent, or Firm*—Nixon & Vanderhye P.C.

(57) ABSTRACT

A drive pulley is formed in a cup-like shape one end side of which is integrally formed with a peripheral wall in a cylindrical shape, the peripheral wall in the cylindrical shape of the drive pulley is formed with openings to be engaged with a ratchet member at intervals of 90 degrees along a circumferential direction, an engaging face for engaging with the ratchet member is formed at a side edge of each for the openings directed in an engine starting direction, and a side edge opened substantially orthogonal to the engaging face or by an angle equal to or larger than 90 degrees is formed at a side edge of the opening on an opposed side opposed to the engaging face.

1 Claim, 7 Drawing Sheets

RECOIL STARTER

BACKGROUND OF THE INVENTION

1. Field of the Invention

The present invention relates to a recoil starter for starting an engine by rotating a crankshaft by rotating a rope reel by pulling a recoil rope wound around the rope reel and transmitting rotation of the rope reel to a drive pulley or the like connected to the crankshaft of the engine via a one-dimensional rotating mechanism of a ratchet mechanism or the like.

2. Description of the Related Art

There is known a recoil starter for starting an engine by rotating a crankshaft of the engine by rotatably providing a rope reel formed with a reel portion at an outer peripheral portion thereof at inside of a case, rotating the rope reel in an engine starting direction by pulling one end portion of a recoil rope wound around the rope reel and drawn out to outside of the case, and transmitting rotation of the rope reel to a rotating member of a flywheel magnet, a drive pulley or the like coupled to the crankshaft of the engine. According to the above-described recoil starter, between the rope reel rotated by operating to pull the recoil rope and the rotating member attached to the crankshaft of the engine, there is provided a ratchet mechanism operated to transmit rotation to a side of the rotating member by being engaged with the rotating member when the rope reel is rotated in the engine starting direction by the recoil rope, and preventing rotation of the rope reel in an inverse direction from being transmitted to the side of the rotating member and preventing rotation on a side of the engine from being transmitted to a side of the rope reel by being separated from the rotating member when the rope reel is rotated in a direction inverse to the engine starting direction in order to wind back the recoil rope drawn out from rope reel and after the engine has been started.

There is known the ratchet mechanism of the recoil starter in which there is formed a ratchet member one end side of which is supported rotatably by the rope reel and which is made to be pivoted in an outer diameter direction by rotating the rope reel, a peripheral wall in a cylindrical shape is formed on an outer peripheral side of the ratchet claw, a drive pulley formed with an opening engageable with the ratchet claw is arranged at the peripheral wall, a front end portion of the ratchet claw is projected from the opening to an outer peripheral side of the drive pulley, and the ratchet claw is engaged with an edge of the opening of the drive pulley to thereby transmit rotation on a side of the rope reel to the drive pulley. Since the ratchet claw is supported at two locations of an inner peripheral side and an outer peripheral side of the opening of the drive pulley, a load applied on the ratchet claw can be alleviated, and light-weighted formation and small-sized formation of the recoil starter can be achieved.

According to the above, it is shown that the ratchet claw is formed by a plate-like material constituted by bending a steel plate having a comparatively thin thickness in an angle-like shape, an axially supporting portion is formed by rolling one end portion of the ratchet claw in a cylindrical shape, the axially supporting portion is pivotably contained at inside of a containing hole formed at a side face of the rope reel, and rotation on the side of the rope reel is transmitted to the side of the drive pulley by engaging the ratchet claw in the plate-like shape with the edge of the opening formed at the peripheral wall of the drive pulley, and by forming to work the drive pulley by a synthetic resin, light-weighted formation thereof is achieved and the drive pulley can be fabricated inexpensively, as disclosed in JP-UM-A-2-124268.

According to the above, there are formed the openings formed at the peripheral wall in the cylindrical shape of the drive pulley for engaging with the above-described ratchet claws at six locations at equal intervals in a circumferential direction, and the side edges on both sides of the respective openings are formed by faces substantially in parallel with each other or in parallel with radial direction lines extended from a center of the drive pulley. When the directions of the side edges of the respective openings are formed in this way, in the case of forming to work the drive pulley by a synthetic resin, the drive pulley needs to be formed by a number of portions constituted by moving forming dies in respectively different directions and the cost is increased in forming the dies and in forming steps. Further, a number of pieces of the drive pulleys cannot be formed to work to hamper the forming cost from being reduced.

SUMMARY OF THE INVENTION

It is an object of the invention to provide a recoil starter resolving in the above-described problem, achieving a strength sufficient for an impact load with a ratchet claw formed on a side of a rope reel, capable of reducing fabrication cost by being enabled to form to work by plastic or the like and capable of achieving small-sized and light-weighted formation.

In order to resolve the above-described problem, a recoil starter of the invention is characterized in a recoil starter for starting an engine by transmitting rotation of a rope reel to a drive pulley by rotating the rope reel in an engine starting direction by pulling a recoil rope and engaging a ratchet member with the drive pulley, wherein the drive pulley is formed in a cup-like shape one end side of which is integrally formed with a peripheral wall in a cylindrical shape, the peripheral wall in the cylindrical shape of the drive pulley is formed with four openings for engaging with the ratchet members at intervals of 90 degrees along a circumferential direction, an engaging face for engaging with the ratchet member is formed at a side edge of each of the openings directed in the engine starting direction, and a side edge of the opening on an opposed side opposed to the engaging face is formed with a side edge opened substantially orthogonally to the engaging face or by an angle equal to or larger than 90 degrees.

As described above, according to the proposal, the drive pulley is formed in the cup-like shape the one end side which is integrally formed with the peripheral wall in the cylindrical shape, the peripheral wall in the cylindrical shape of the drive pulley is formed with the four openings to be engaged with the ratchet members at the intervals of 90 degrees along the circumferential direction, the engaging face for engaging with the ratchet member is formed at the side edge of each of the openings directed in the engine starting direction, the side edge of the opening of the opposed side opposed to the engaging face is formed with the side edge opened substantially orthogonally to the engaging face or by the angle equal to or larger than 90 degrees and therefore, the peripheral wall portion in the cylindrical shape formed with the four openings can be produced only by forming to work the peripheral wall portion in one motion. Further, a pair of lower female dies each for forming the peripheral wall of an amount of a half periphery and two of the opening portions are opposedly arranged, a plurality of dies of the drive pulleys can be formed along a direction of matching the pair of lower female dies, the die for producing a number of pieces of formed products capable of fabricating a plurality of the drive pulleys by a forming step in one motion can be fabricated and cost of producing the drive pulley can be reduced.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

The invention achieves an object of providing a drive pulley with a sufficient strength against an impact load by a ratchet claw formed on a side of a rope reel and reducing fabrication cost by enabling to form to work the drive pulley by plastic or the like by forming the drive pulley in a cup-like shape one end side of which is formed with a peripheral wall in a cylindrical shape, forming openings to be engaged with the ratchet members at the peripheral wall in the cylindrical shape of the drive pulley at intervals of 90 degrees along a circumferential direction, forming an engaging face to be engaged with the ratchet member at a side edge of each of the openings directed in an engine starting direction, and forming a side edge orthogonal to the engaging face at a side edge of the opening on an opposed side opposed to the engaging face.

Figure 1:
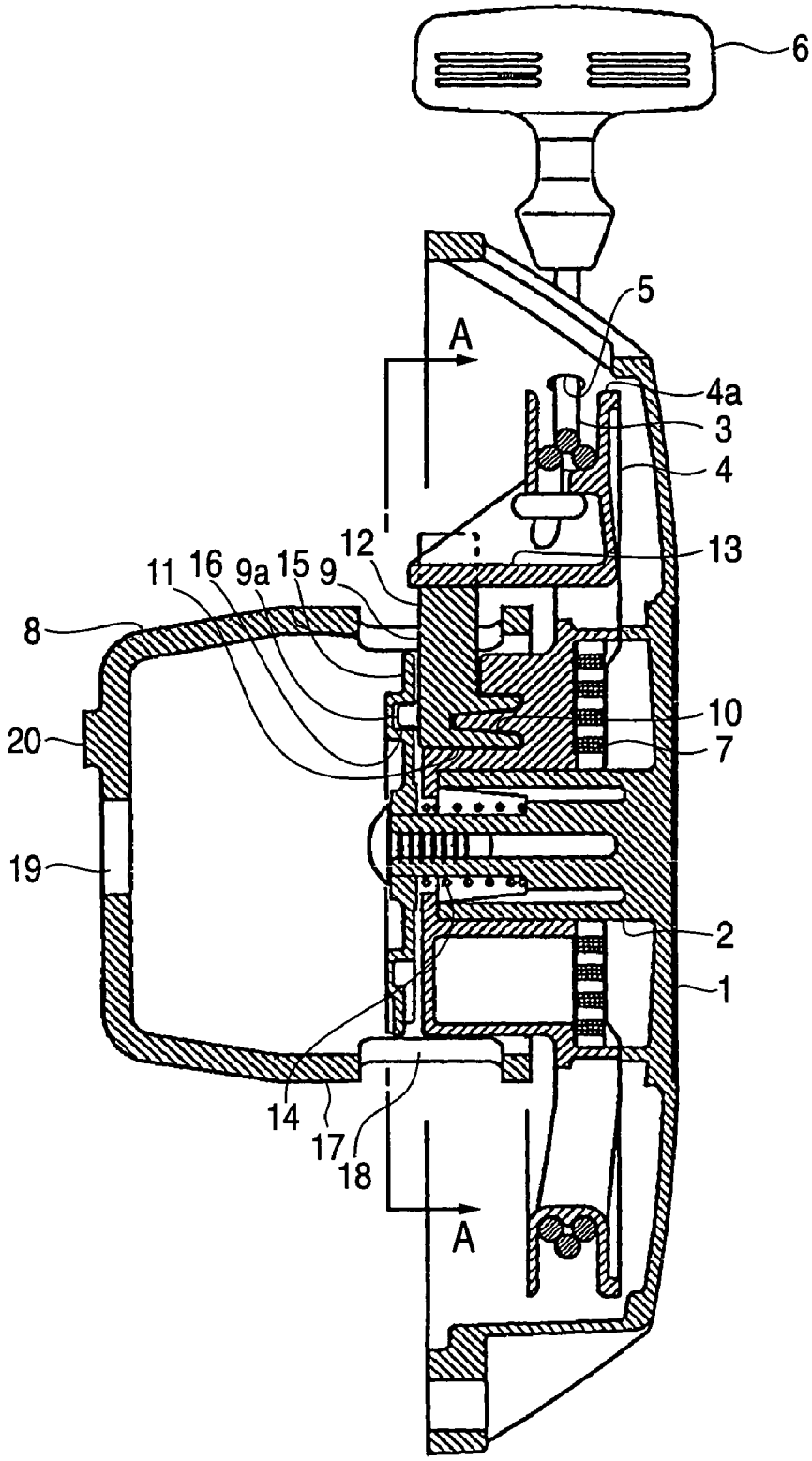
FIG. 1 is a vertical sectional side view of a recoil starter according to an embodiment of the invention.

As shown by FIG. 1, a recoil starter according to an embodiment of the invention is constituted by containing a principal mechanism constituting the recoil starter at inside of a starter case 1 formed to cover one side face of an engine. An inner side face of the starter case 1 is formed with a reel supporting shaft 2 to be opposed to a crankshaft of the engine, and the reel supporting shaft 2 is rotatably mounted with a rope reel 4 wound with a recoil rope 3 at an outer periphery of the reel supporting shaft 2. One end of the recoil rope 3 wound around a reel portion 4*a* formed at an outer periphery of the rope reel 4 is fixed to the rope reel 4 and other end side thereof is drawn out from an opening 5 formed at the starter case 1 as shown by FIG. 2 to an outer side of the starter case 1, and by pulling a handle 6 attached to the other end of the recoil rope 3, the rope reel 4 is rotated in an engine starting direction centering on the reel supporting shaft 2.

Between a side face of the rope reel 4 and an inner wall face of the starter case 1, there is arranged a recoil spiral spring 7 for exerting a rotating force in an inverse direction to the rope reel 4 for reeling back the recoil rope 3 drawn out from the rope reel 4 to the rope reel 4 by rotating the rope reel 4 rotated in the engine starting direction by pulling the recoil rope 3 in the inverse direction. One end side on an inner peripheral side of the recoil spiral spring 7 is fixed to the reel supporting shaft 2, further, other end portion thereof on an outer peripheral side is fixed to the rope reel 4, in rotating the rope reel 4 in the engine starting direction by operating to pull the handle 6 attached to the recoil rope 3, the rotating force is accumulated in the recoil spiral spring 7, and by detaching the handle 6, the recoil rope 3 drawn out to the outer side of the starter case 1 is operated to be reeled back to the rope reel 4 by rotating the rope reel 4 in the inverse direction by the rotating force accumulated in the recoil spiral spring 7.

Figure 2:
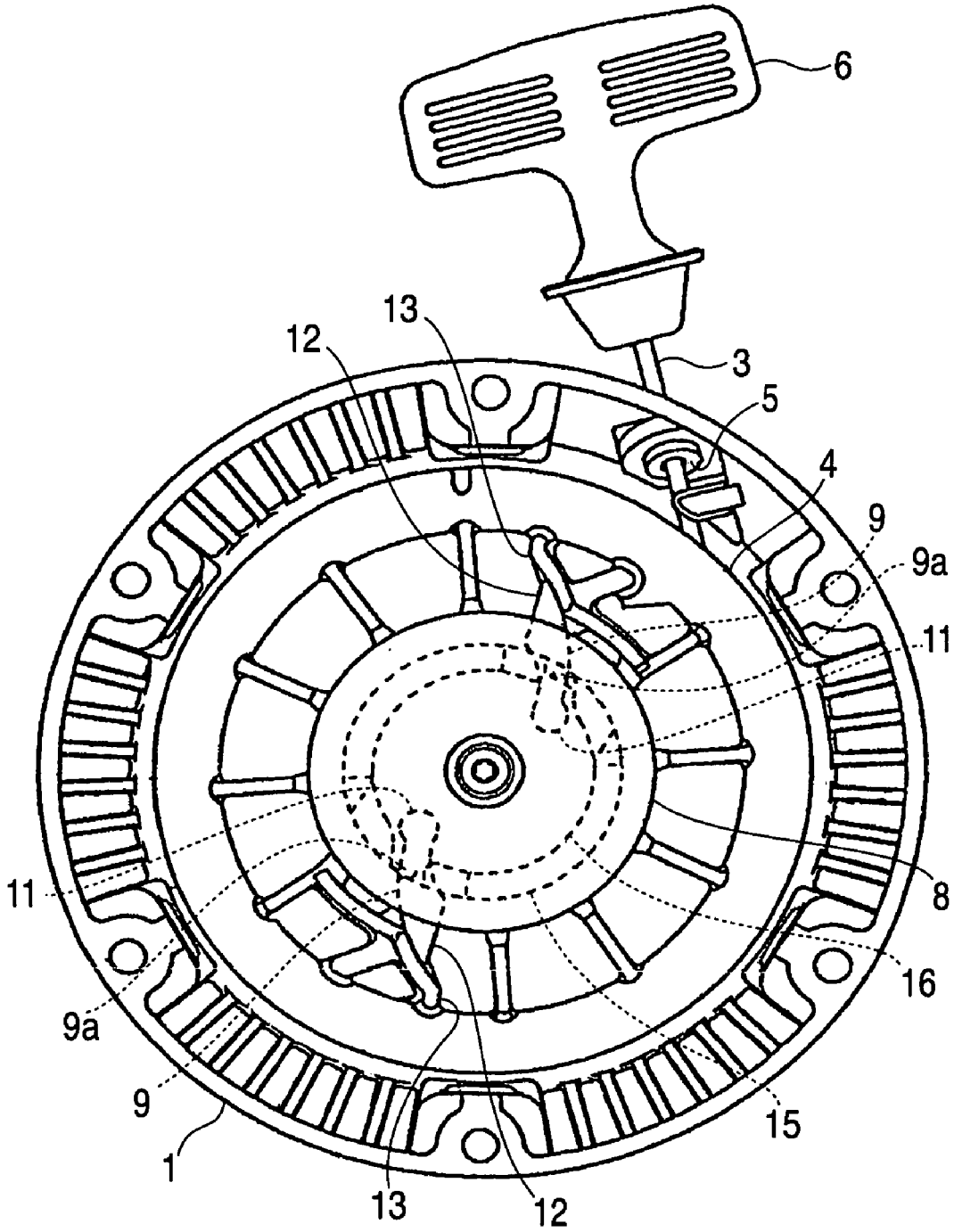
FIG. 2 is a front view of a recoil starter the same as that of FIG. 1.

As shown by FIG. 1 and FIG. 2, a side face of the rope reel 4 is provided with a ratchet member 9 for transmitting rotation of the rope reel 4 in the engine starting direction to a drive pulley 8 attached to a crankshaft of the engine by being pivotably supported on an axis line in parallel with an axis line of the reel supporting shaft 2. The ratchet member 9 is formed by a pivoting shaft portion 11 inserted into a supporting hole 10 formed at a side face of the rope reel 4, and an arm portion 12 extended orthogonally from the pivoting shaft portion 11, and is made to be able to pivot at an interval between positions at which a front end portion of the arm portion 12 is pivoted in an outer peripheral direction to be brought into contact with a receiving member 13 formed in an outer diameter direction of a side face of the rope reel 4 by pivoting the arm portion 12 centering on the pivoting shaft portion 11 supported by the supporting hole 10.

A control member 15 is supported by an end face of the reel supporting shaft 2 in a state of providing a predetermined rotational resistance to the reel supporting shaft 2 by a spring 14, a projected portion 9*a* formed to project from an upper face of the ratchet member 9 is engaged with a control groove 16 formed at an inner side face of the control member 15, the ratchet member 9 is pivoted centering on the pivoting shaft portion 11 by providing a resistance by engaging the projected portion 9*a* of the ratchet member 9 rotated along with the rope reel 4 when the rope reel 4 is rotated relative to the reel supporting shaft 2 with the control groove 16, and the ratchet member 9 is pivoted in a direction in which the front end portion of the arm portion 12 is brought into contact with the receiving member 13 formed in the outer diameter direction of the rope reel 4. After bringing the front end of the ratchet member 9 into contact with the receiving member 13, the control member 15 is rotated integrally with the rope reel 4 and the ratchet member 9 against the rotational resistance.

The drive pulley 8 integrally coupled with the crankshaft of the engine is formed in a cup-like shape formed with a peripheral wall 17 in a cylindrical shape at one end side thereof, and the peripheral wall 17 in the cylindrical shape of the drive pulley 8 is formed with four openings 18 formed by cutting to remove portions of the peripheral wall 17 at equal intervals in a circumferential direction. When the starter case 1 of the recoil starter is attached to the engine in a state of attaching the drive pulley 8 to the crankshaft of the engine, in a portion of the peripheral wall 17 in the cylindrical shape of the drive pulley 8 is arranged between an outer periphery of the control member 15 and the receiving member 13 formed at the rope reel 4, and when the end portion of the arm portion 12 of the ratchet member 9 is pivoted in the outer diameter direction, by projecting the arm portion 12 to the outer peripheral side of the drive pulley 8 by penetrating the opening 18 and engaging the arm portion 12 with an end edge of the opening 18, rotation of the rope reel 4 in the engine starting direction is transmitted to the side of the drive pulley 8 via the ratchet member 9.

Figure 3:
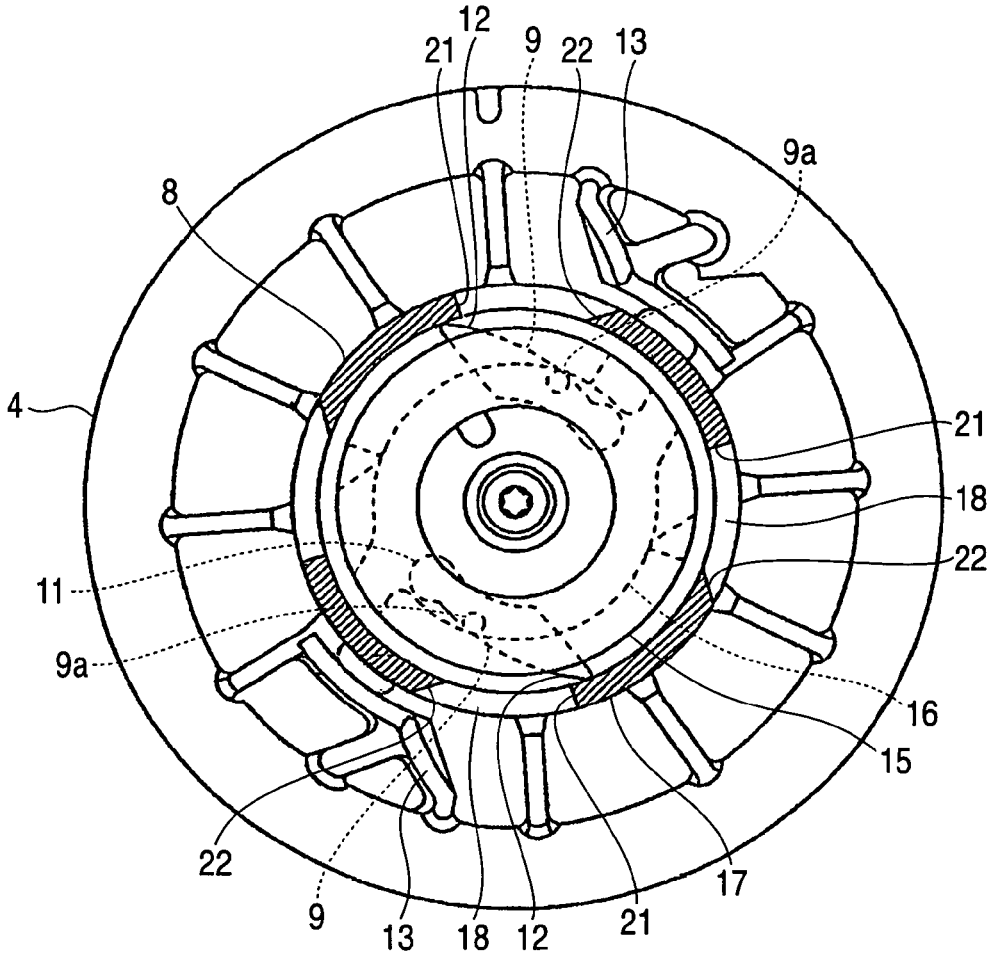
FIG. 3 is a sectional view taken along a line A—A of FIG. 1.

Before operating to start the engine, as shown by FIG. 3, in the ratchet member 9, the arm portion 12 is pivoted to an inner side and a front end portion thereof is arranged on an inner side of the peripheral wall 17 of the drive pulley 8. By operating to pull the recoil rope 3 from the state, the rope reel 4 is rotated in the engine starting direction, and the ratchet member 9 is rotated integrally with the rope reel 4. The control member 15 is attached to the reel supporting shaft 2 by the predetermined rotational resistance and therefore, the control member is not rotated, and the projected portion 9*a* of the ratchet member 9 is engaged with the control groove 16 formed at the control member 15 to pivot the ratchet member 9 centering on the pivoting shaft portion 11 to pivot the arm portion 12 in the outer diameter direction.

Figure 4:
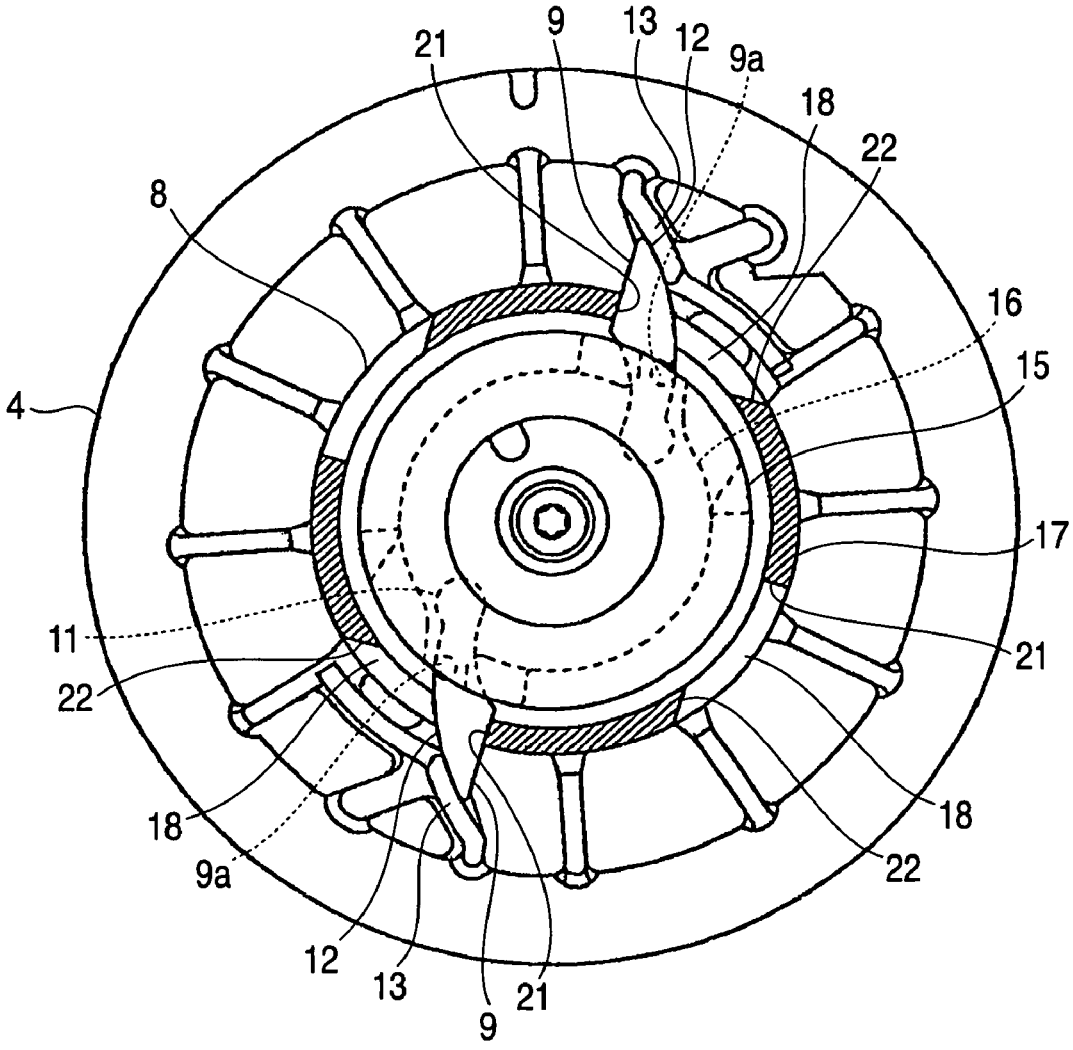
FIG. 4 is a sectional view the same as that of FIG. 3 in a state of transmitting rotation of a rope reel to a drive pulley.

When the arm portion 12 of the ratchet member 9 is pivoted in the outer diameter direction, as shown by FIG. 4, the front end of the arm portion 12 of the ratchet member 9 is pivoted in the outer diameter direction by penetrating the peripheral wall 17 of the drive pulley 8 from the opening 18 formed at the peripheral wall 17 of the drive pulley 8 and the front end portion of the arm portion 12 is brought into contact with the receiving member 13 formed on an outer peripheral side of the rope reel 4 to stop pivoting the ratchet member 9. By further rotating the drive pulley 8, the ratchet member 9 is engaged with a side edge of the opening 18 of the drive pulley 8 directed in the engine starting direction and the drive pulley 8 is rotated integrally with the rope reel 4 to start the engine.

After starting the engine, by rotating the crankshaft in the engine starting direction, the drive pulley 8 is rotated, an end edge of the drive pulley 8 on an opposed side is engaged with the ratchet member 9 to pivot the ratchet member 9 such that the arm portion 12 is moved in the inner diameter direction, and by separating the ratchet member 9 from the drive pulley 8 thereby, rotation on the side of the engine is not transmitted to the rope reel 4. Further, when the engine is not started, the rope reel 4 is rotated in an inverse direction by a rotating force accumulated at the recoil spiral spring 7 by loosening the recoil rope 2 to thereby reel back the recoil rope 2 to the rope reel 4. At this occasion, also the ratchet member 9 is rotated integrally with the rope reel 4 in the inverse direction, and by engaging the projected portion 9*a* formed at the ratchet member 9 with the control groove 16 of the control member 15, the arm portion 12 of the ratchet member 9 is pivoted in the inner diameter direction to pivot to the inner peripheral side of the peripheral wall 17 of the drive pulley 8 and rotation of the rope reel 4 in the inverse direction is not transmitted to the side of the drive pulley 8.

Figure 5:
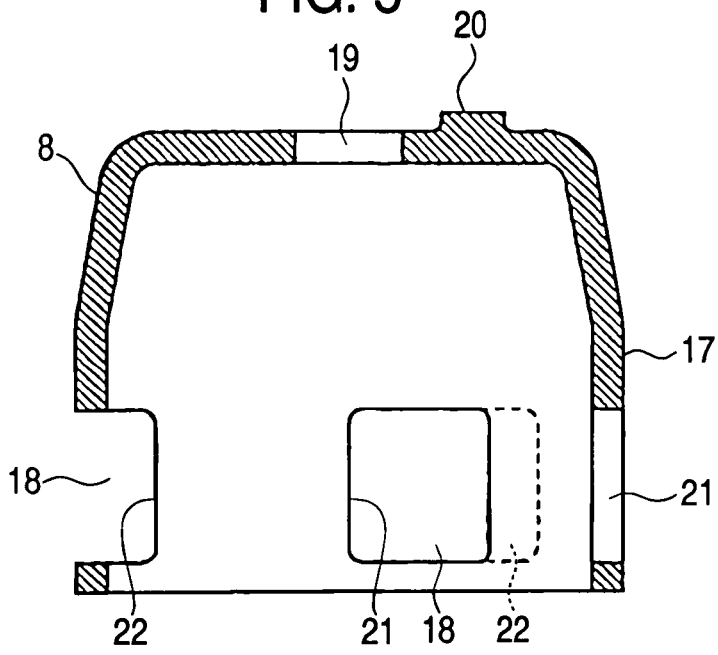
FIG. 5 is a vertical sectional side view of a drive pulley adopted in the recoil starter of FIG. 1.
Figure 6:
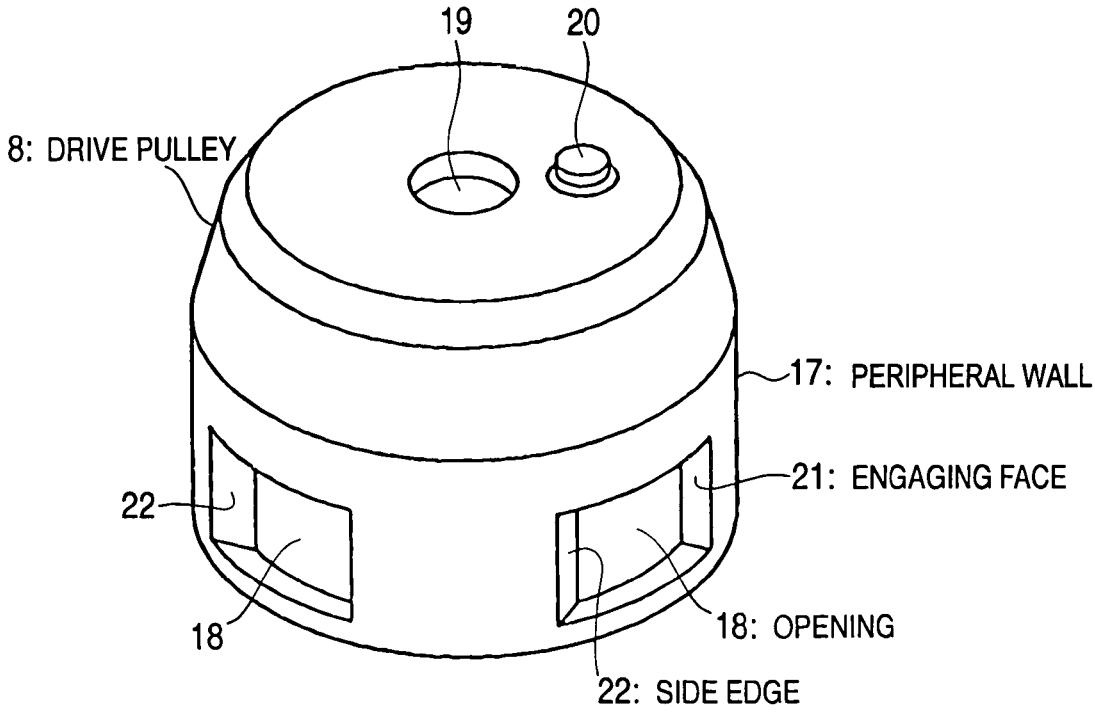
FIG. 6 is a perspective view of a drive pulley the same as that of FIG. 5.

As shown by FIG. 5 and FIG. 6, the drive pulley 8 is formed in the cup-like shape the one end side of which is opened by forming to work a synthetic resin. An opening 19 for fixing the crankshaft of the engine is formed on a center line on a side of an end portion of the drive pulley 8 which is not opened, and a projection 20 for stopping rotation is integrally formed at an eccentric position shifted from the center line. The peripheral wall 17 in the cylindrical shape formed on the side of the opened end edge is formed with the four openings 18 capable of being engaged with the arm portions 12 of the above-described ratchet member 9 at equal intervals spaced apart from each other at the intervals in the peripheral direction. A side edge of each opening 18 of the drive pulley 8 projected in the engine starting direction is formed with an engaging face 21 for transmitting rotation from the rope reel 4 to the drive pulley 8 by being engaged with the above-described ratchet member 9, and an angle of the engaging face is set to coincide with an angle of the arm portion 12 of the ratchet member 9 to be able to be engaged with the arm portion 12 of the ratchet member 9 projected from the opening 18 in a wide area. A side edge of the opening 18 directed to a side opposed to the engine starting direction is formed with a side edge 22 formed by a face substantially orthogonal to the engaging face 21.

Figure 7:
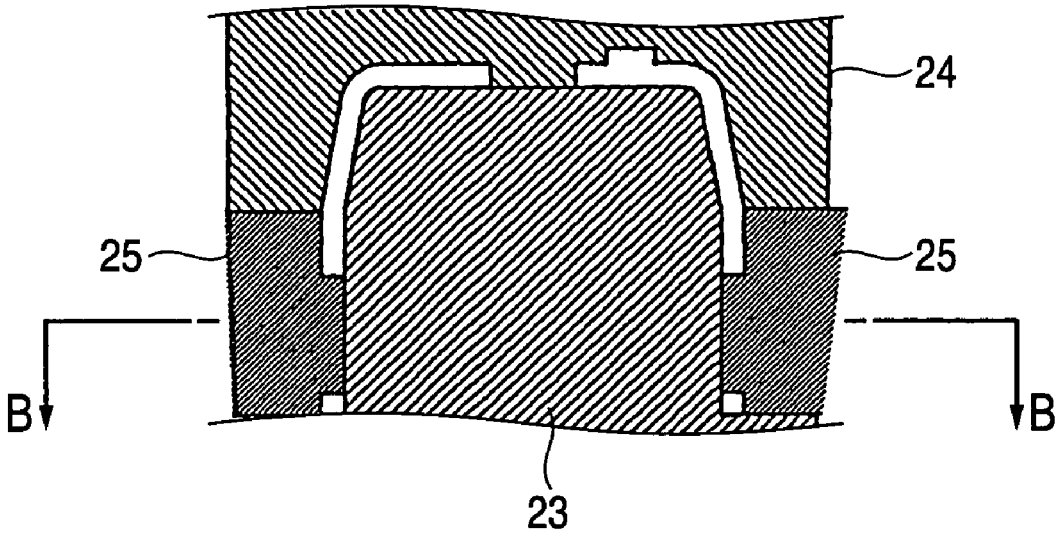
FIG. 7 is a vertical sectional side view showing a state of forming a drive pulley by a forming die.
Figure 8:
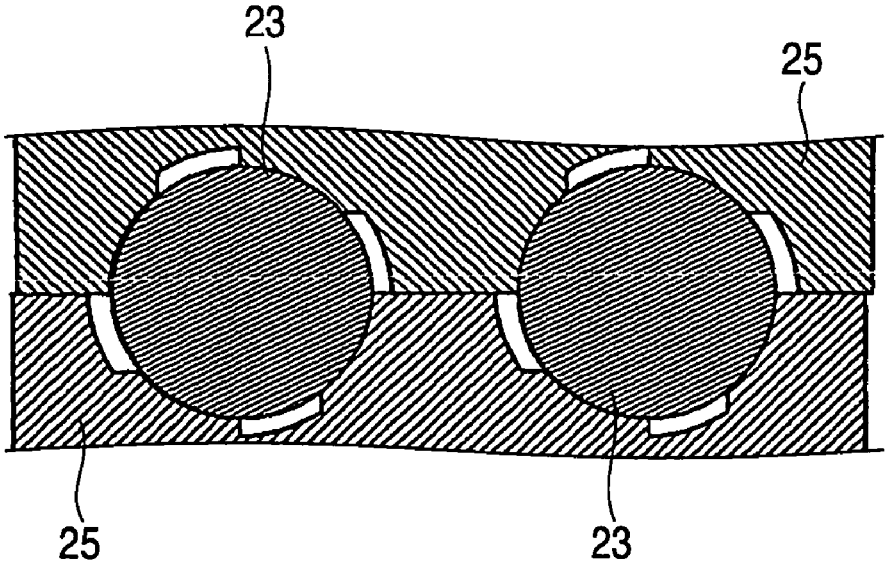
FIG. 8 is a sectional view taken along a line B—B of FIG. 7.
Figure 9:
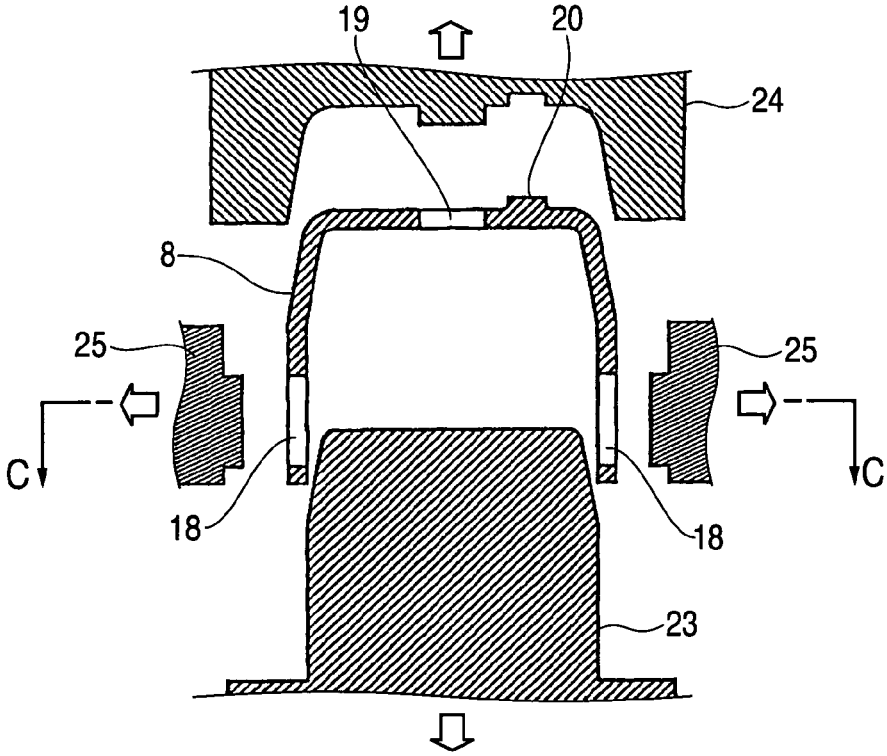
FIG. 9 is a vertical sectional side view showing a state of drawing the drive pulley after having been formed from the die.
Figure 10:
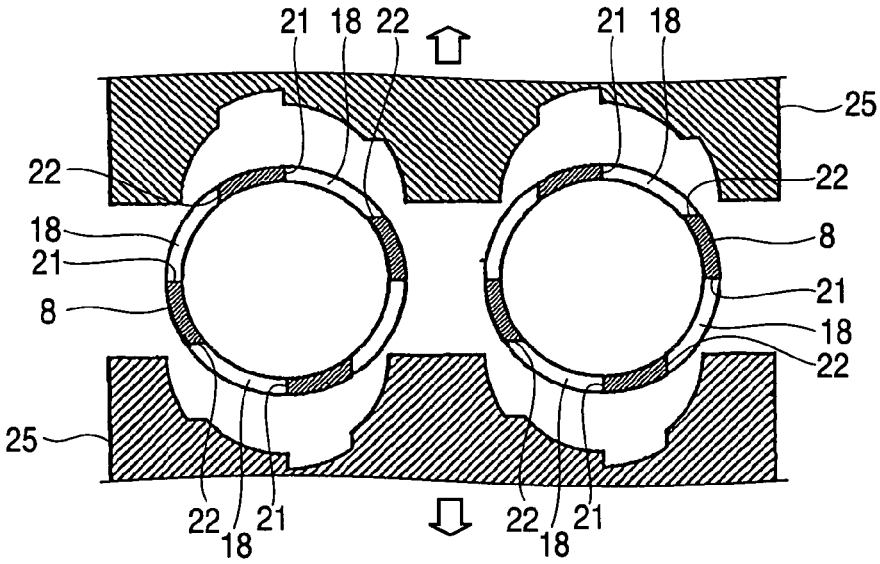
FIG. 10 is a sectional view taken along a line C—C of FIG. 9.

FIG. 7 through FIG. 10 show an embodiment showing a state of forming to work the drive pulley 8 according to the above-described embodiment, the drive pulley 8 is formed by being formed to work by a male die 23 for forming an inner side face of the drive pulley 8, and a female die for forming an outer shape of the drive pulley 8, as shown by FIG. 7 and FIG. 8, the female die is formed by being divided into an upper female die 24 for forming an upper outer shape of the drive pulley 8 and a lower female die 25 for forming the outer peripheral face of the peripheral wall 17 in the cylindrical shape of a lower portion of the drive pulley 8, further, by forming the lower female die 25 for forming the outer peripheral face of the peripheral wall 17 of the drive pulley 8 and the openings 18 by dividing the lower female die 25 in two along the face of the engaging face 21 of the openings 18 such that the outer side face of the peripheral wall 17 of an amount of a half periphery and the two contiguous openings 18 are formed, the drive pulley 8 formed with the four openings 18 can be produced by forming to work the drive pulley 8 in one motion.

The engaging face 21 forming the opening 18 of the drive pulley 8 and the side edge 22 formed to be opposed to the engaging face 21 are formed by the faces directed in directions orthogonal to each other, further, the four openings 18 are formed at intervals of 90 degrees along the circumferential direction of the drive pulley 8 and therefore, the lower female die 25 for forming the outer peripheral wall face of the peripheral wall 17 of the amount of the half periphery and the two contiguous openings 18 is formed as described above, a pair of the lower female dies 25 are arranged to be opposed to each other to mold, and a molded product can be drawn from the dies by moving the respective dies in directions opposed to each other as shown by arrow marks in the drawing Further, a plurality of the dies of the drive pulleys 8 can be formed along a direction of matching the lower female dies 25, and dies for producing a number of pieces of the molded products capable of fabricating a plurality of the rive pulleys 8 by a forming step in one motion can be provided and the cost of producing the drive pulley 8 can be reduced.

As described above, the substantially orthogonal side edges signify to provide escapements such that the lower female dies 25 can be slid in a lateral direction and therefore, the angle may be equal to or larger than 90 degrees relative to an edge face of the opening.

What is claimed is:

1. A recoil starter comprising:

a starter case formed with a reel supporting shaft to be opposed to an axis line of a crankshaft of an engine;

a rope reel wound with a coil rope one end of which is drawn out to an outer side of the starter case and pivotably supported by the reel supporting shaft;

a recoil spiral spring for urging to rotate the rope reel in a direction of winding the recoil rope; and a ratchet member provided at the rope reel for transmitting rotation of the rope reel to a drive pulley by being engaged with the drive pulley provided on a side of the crankshaft of the engine, wherein:

the engine is started by transmitting the rotation of the rope reel to the drive pulley by rotating the rope reel in an engine starting direction by pulling the recoil rope and engaging the ratchet member with the drive pulley;

the drive pulley is formed in a cup-like shape one end side of which is integrally formed with a peripheral wall in a cylindrical shape;

the peripheral wall in the cylindrical shape of the drive pulley is formed with four openings for engaging with the ratchet members at intervals of 90 degrees along a circumferential direction;

an engaging face for engaging with the ratchet member is formed at a side edge of each of the openings directed in the engine starting direction; and a side edge of each of the openings on an opposed side opposed to the engaging face is formed with a side edge opened substantially orthogonally to the engaging face or by an angle equal to or larger than 90 degrees.

* * * * *